US005701713A

United States Patent [19]

Silver

[11] Patent Number: 5,701,713

[45] Date of Patent: Dec. 30, 1997

[54] ADJUSTABLE TRUSS

[76] Inventor: Daniel J. Silver, 3117 Broadway, Apt. 44, New York, N.Y. 10027

[21] Appl. No.: 626,766

[22] Filed: Mar. 29, 1996

[51] Int. Cl.[6] ..... E04C 3/02; E04B 1/343

[52] U.S. Cl. ..... 52/645; 52/640; 52/639; 52/646; 52/745.14; 52/741.1

[58] Field of Search ..... 52/646, 645, 639–641, 52/648.1, 81.2, 81.3, 223.8, 109, 745.19, 745.12, 741.1, 90

[56] References Cited

U.S. PATENT DOCUMENTS

| | | | |
|---|---|---|---|
| 3,757,476 | 9/1973 | Schoen | 52/81.2 |
| 3,889,433 | 6/1975 | Eubank, Jr. . | |
| 4,253,284 | 3/1981 | Bliss | 52/109 |
| 4,539,786 | 9/1985 | Nelson | 52/646 |
| 4,557,083 | 12/1985 | Zanardo | 52/109 |
| 4,619,099 | 10/1986 | Sircovich . | |
| 4,655,022 | 4/1987 | Natori | 52/646 |
| 4,689,932 | 9/1987 | Zeigler | 52/109 |
| 4,771,585 | 9/1988 | Onada et al. | 52/646 |
| 4,809,471 | 3/1989 | Wichman et al. . | |
| 4,888,895 | 12/1989 | Kemeny . | |
| 4,890,429 | 1/1990 | Gatzka et al. . | |
| 4,942,686 | 7/1990 | Kemeny . | |
| 4,942,700 | 7/1990 | Hoberman . | |
| 5,024,031 | 6/1991 | Hoberman | 52/646 |
| 5,125,205 | 6/1992 | Wichman | 52/109 |
| 5,125,206 | 6/1992 | Motohashi et al. . | |
| 5,163,262 | 11/1992 | Adams | 52/646 |
| 5,230,196 | 7/1993 | Zeigler | 52/646 |
| 5,337,531 | 8/1994 | Thompson et al. . | |
| 5,444,946 | 8/1995 | Zeigler . | |

OTHER PUBLICATIONS

NASA Contractor Report 3273 (1980) "A Design Procedure for a Tension–Wire Stiffened Truss–Column", by William H. Greene.

Proceedings of the 1989 International Symposium on Antennas and Propagation (1989) 73–77, "The Tension Truss Antenna Concept", by Koryo Miura and Yasuyuki Miyazaki.

JSME International Journal, Series III, vol. 33 No. 2. (1990) 183–90, "Dynamic Analysis of a Truss–Type Flexible Robot Arm", by Y. Seguchi, M. Tanaka, T. Yamaguchi, Y. Sasabe and H. Tsuji.

Proceedings of the 1991 American Control Conference (1991) 2466–74, "Sliding Mode Control of Vibration in Flexible Structures Using Estimated States", by C.K. Kao and A. Sinha.

Journal of Intelligent Material Systems and Structures, vol. 2, No. 3/Jul. 1991, 347–85, "Identification and Adaptive Control of Flexible Truss Structures", by Koji Sekine, Yuzo Shibayama, Naotoshi Iwasawa and Norio Tagawa.

Journal of Intelligent Material Systems and Structures, vol. 3, No. 1/Jan. 1992, 54–74, "Adaptive Structures Research at ISAS, 1984–1990", by Koryo Miura.

Journal of Intelligent Material Systems and Structures, vol. 3, No. 4/Oct. 1992, 697–718, "Adaptive Control of Space Truss Structures by Piezoelectric Actuator", by Shigeto Shibuta, Yoshiki Morino, Yuzo Shibayama and Koji Sekine.

(List continued on next page.)

*Primary Examiner*—Robert Canfield

*Attorney, Agent, or Firm*—Pennie & Edmonds LLP

[57] ABSTRACT

An adjustable truss is made up of a chain of truss elements sharing common edges. Pairs of adjacent elements are pivotally joined at their common edges, these shared edges acting as hinges. Tension cables are slidably received at the ends of each hinge. The truss can be erected by providing tensile forces in the tension cables. The precise angle of a specific hinge is controlled by actuators driving mechanical linkages connecting the adjacent truss elements associated with that hinge. The mechanical linkages serve to guide the amount of the forces from the cables which are applied to the hinge. In this way, the truss as a whole can be adjusted through an infinite range of configurational changes in three dimensions. The tension cables can be clamped at each hinge end, locking the selected hinge angles and pre-stressing the overall structure. In this way, the truss elements bear the compressive loads, while the cables bear the tensile loads. The truss can alternatively be erected using either the tension cables or the mechanical linkages alone.

24 Claims, 7 Drawing Sheets

OTHER PUBLICATIONS

NASA Technical Paper 3307, Nov. 1992 "Structurally Adaptive Space Crane Concept for Assembling Space Systems on Orbit", by John T. Dorsey, Thomas R. Sutter, and K. Chauncey Wu.

International Journal of Space Structures, vol. 8 Nos. 1&2 (1993) 3–16, "Concepts of Deployable Space Structure", by K. Miura.

Smart Mater. Struct. 2 (1993) 240–48, "Shape Adjustment of Precision Truss Structures: Analytical and Experimental Validation", by M. Salama, J. Umland, R. Bruno and J. Garba.

Solar Engineering 1993, ASME International Solar Energy Conference, Apr. 4–9, 1993, "Solar Concentrator Support Structure", by Gordon L. Ritchie.

The Construction Specifier, vol. 47, No. 2, Feb. 1994, 42–50, "Stressed Arch Roofing", by Edward Riley.

Cooperative Institute for Research in Environmental Science, Colorado University (1994) "A Structural Design Methodology For Large Angle Articulated Trusses Considering Realistic Joint Modeling", by G. Thorwald and M.M. Mikulas.

IEEE 1994 International Symposium Digest Antennas and Propagation, vol. 2 (1994) 878–81, "A Tension–Truss Deployable Antenna for Space–Use and Its Obtainable Characteristics", by T. Takano, M. Natori and K. Miyoshi.

NASA Conference Publication 3278, Proceedings of the XIII Space Photovoltaic Research and Technology Conference (1994) 299–312, "Static Stability of a Three–Dimensional Space Truss", by J.F. Shaker.

ADJUSTABLE TRUSS

TECHNICAL FIELD

The present invention relates generally to structural frameworks and more particularly to adjustable truss structures.

BACKGROUND ART

It is well-known to build rigid three-dimensional truss structures (in the form of truss beams or planar truss arrays) out of tetrahedral elements which are joined at their common faces. Such truss structures are used in the construction of both temporary and permanent building structures, in display frames, exhibition and exposition environments, and space structures.

It is useful to be able to adjust the shape of a truss structure. This permits easy transportation of the structure in a folded state, simplifies erection on-site, and provides the ability to adjust the shape of the structure after it is erected. Some work in this area is concentrated in developing folding and adjustable truss structures for space applications, which require that the structures be able to fold into a small volume for transportation.

It is known to permit the adjustment of the shape of a truss structure by using telescoping members as part of the load-bearing structure of the truss. For example, U.S. Pat. No. 5,125,206 to Motohashi et al. describes a cubical truss element having a frame of fixed-length rods and telescoping diagonal bracing rods. By extending and retracting the diagonal bracing rods, the cubical truss element can be deformed into a parallelepiped. When a plurality of cubical elements are coupled to form a truss structure, deformation of multiple cubical elements can effect a change in the overall shape of the structure.

Another example of a structure using telescoping members is shown in U.S. Pat. No. 4,655,022 to Natori, which shows a tetrahedral truss element which is deformable in shape. Some of the rods forming the edges of the tetrahedral unit are foldable by means of a joint, and some of the other rods are telescopic. By extending or contracting the telescopic rods, and folding the foldable rods, the shape of the individual tetrahedral elements can be adjusted. A plurality of such tetrahedral elements are coupled at their common planes to form an adjustable truss beam. By adjusting a plurality of the tetrahedral units, the shape of the overall truss beam can be adjusted.

Trusses of this type use rigid telescoping struts (typically electro-mechanical actuators) to effect the shape adjustment. A disadvantage of this approach is that the telescoping elements perform a structural function as well as a shape-adjustment function, and are therefore directly subject to all the static and dynamic loads borne by the truss structure. By subjecting the actuators to tensile and compressive loads, there is a risk of loss of position accuracy if the actuators were to "slip" in response to the loads. Alternatively, it may be required to keep the actuators continuously powered in order to counteract structural loads. By subjecting the actuators to bending moments, there is a risk of loss of structural integrity, as actuators typically are not as resistant to bending moments as are simple fixed-length struts. In order to withstand expected structural load conditions, it will be necessary to use a much sturdier actuator than would be required simply to perform the shape adjustment of the truss. This over-specification will result in a heavier structure and will be more expensive than if the actuators were only required to perform the shape-adjusting function. Therefore, it is desirable to design an adjustable truss structure in which the shape-adjusting members do not bear structural loads.

Another disadvantage to placing the shape-adjusting members directly in the truss itself is that such configuration does not take advantage of the principles of mechanical advantage; the actuating means in known truss structures must directly create the full amount of force required to adjust the shape of the truss. It is highly desirable to employ the principles of mechanical advantage and thereby reduce the required actuator force, as this will permit the use of smaller, lighter, and less expensive actuating means.

It is also known to construct building trusses out of triangular elements which are pivotally attached at their adjacent corners. These trusses can be erected from flat to arched configuration by pushing the ends of the truss together. For example, U.S. Pat. No. 4,890,429 to Gatzka et al. illustrates a truss formed of upper and lower chords with the lower chord having a plurality of lengths of tube slidably received over a tensioning cable. By tensioning the cable, the truss is bowed upward to form an arched truss. The erected shape of the truss is determined by the lengths of the abutting tube segments.

An example of a truss using similar principles is shown in U.S. Pat. No. 4,169,099 to Sircovich. This truss is formed of pivotally joined triangular structural elements with fixed lengths of wires connecting adjacent elements. When the truss is flat, the wires are slack. As the ends of the structure are pushed together, the truss as a whole is bowed upward to form an arch which reaches its erected state when the wires become taut.

Trusses of this type offer the convenience of easy erection, but do not permit adjustment of the shape of the erected structure, as the final erected shape is predetermined when the dimensions of the various components are selected. Furthermore, trusses of this type can be characterized as being "2-dimensional," in that during erection and in the final configuration, the truss is constrained to remain in a plane defined by the two ends of the truss.

Traditional building trusses, including those discussed above, generally require a flat foundation as a prerequisite to begin construction. This requirement is costly in terms of grading and site preparation, and may often preclude erection on certain uneven or sloped sites altogether. Therefore, there is a need for an erectable truss structure which is adaptable to uneven and sloping sites and which reduced the cost of site preparation.

As the discussion above illustrates, there continues to be a need in the art for an adjustable structural truss wherein the actuator means do not perform a structural function, which does not require great actuator force for shape adjustment, which is adjustable in three dimensions both after the components have been selected and after the truss is erected, which has means for facilitating a partially erected configuration, and furthermore, which can easily be erected on an uneven site.

SUMMARY OF THE INVENTION

It is therefore an object of the present invention to provide a truss structure which allows for three-dimensional adjustability both after the components are selected and after the truss is erected.

The truss structure of the present invention is constructed from a series of rigid truss elements, preferably equilateral tetrahedrons in shape, which are connected at their adjacent edges. According to one embodiment of the invention, the tetrahedral elements are composed of struts forming an open framework. Each tetrahedron is pivotally coupled to its neighbors; this pivotal coupling is achieved by sharing a single strut as the edge for each adjacent tetrahedron. This shared strut represents the hinge for the pivotal coupling between neighboring tetrahedra.

The truss structure is constructed by consecutively coupling tetrahedral elements in this way. In the preferred embodiment of equilateral tetrahedral truss elements, successive hinges in the truss structure are orthogonal. This is in significant contrast to the pivoting axes in the "two-dimensionally" adjustable trusses known in the art. The lack of parallelism of the hinges advantageously allows the truss structure of the current invention to be adjustable in three dimensions.

The truss structure may be laid on a flat surface, in a linear configuration. The structure is then in its initial, or unadjusted state. For example, the truss could be laid on a surface such that the first, third, fifth, etc. hinges will be parallel to the surface, and the second, fourth, sixth, etc. hinges will be perpendicular to the surface. The hinges form two identifiable sets, all the hinges in each set being parallel with each other, and perpendicular to the hinges in the other set. The two sets of hinges define non-coplanar bending planes for the overall truss structure. By a combination of adjustments in the angles of the individual hinges in the two bending planes, full three dimensional adjustment of the overall structure can be achieved.

For example, if the angle of any of the hinges perpendicular to the surface is adjusted, this will only effect a change in the shape of the truss structure in a plane parallel with the surface. However, if the angle of any of the hinges parallel to the surface is adjusted, this will necessarily effect a change in the shape of the truss structure out of the plane parallel with the surface, thus erecting the truss up from the surface.

It is a further object of the present invention to provide an adjustable truss structure wherein the adjustment means do not perform a structural function. In the preferred embodiment of the present invention, the truss elements described above are of fixed shape. Adjustment of the shape of the overall truss is not achieved by deforming the shape of the truss elements, but by adjusting the hinge angle between the truss elements.

The adjustment of a specific individual hinge angle in the present invention is preferably achieved by providing tension cables running the length of the truss structure, and mechanical adjustment assemblies associated with individual hinges. The application of tensile forces in the tension cables provides a force tending to effect a change in the hinge angles. As these tensile forces are being applied, the mechanical adjustment assemblies may be used to provide a supplemental force, in addition to the primary shaping force provided through the tension cables. The supplemental force serves to modulate the amount of force from the tension cables which is applied to the individual hinges. The supplemental force is provided by an actuator, through a linkage designed to amplify the force provided by the actuator. By employing the principles of mechanical advantage, the actuator force required to control the shape adjustment can be significantly reduced. In alternate embodiments of the invention, shape adjustment can be accomplished using either the cables or the adjustment assemblies alone.

It is a further object of the present invention to provide an adjustable truss structure which has means for bearing the compressive loads in rigid structural members, and the tensile loads in flexible structural members, such as cables. This advantageously allows for a greater strength-to-weight ratio as compared to structures known in the art.

In the preferred embodiment, the ends of each hinge slidably receive steel tension cables. There are a pair of such cables associated with each set of initially parallel hinges. After a specific hinge is adjusted to the desired angle, that hinge angle position is maintained by clamping the tension cables, thereby fixing the length of the cable segments associated with the hinge of interest. Forces tending to change the hinge angle will be opposed by tension in the cable segments. In this way, all of the loads required to maintain hinge angle positions are carried by the cable segments. The cables therefore serve to unload the adjustment assemblies and actuators, so that these elements do not bear any structural loads in the erected structure. In this completed configuration, all compressive loads in the truss structure are carried by the rigid struts which form the tetrahedral truss structure. To the extent that the cables are placed under tension before being clamped, tensile forces in the truss structure will be carried primarily by the cables.

The actuators and adjustment assemblies may optionally be removably connected to the truss structure. After the position of a specific hinge is adjusted and then fixed by clamping the associated cable segments as described above, the actuator and adjustment assembly are no longer required to maintain the selected hinge angle. Therefore, these components may be disconnected from the truss structure. The actuator and adjustment assembly may then be reconnected to the truss structure at a different location, to adjust a different hinge. This process can be repeated as necessary until all hinge angles are adjusted as desired, after which the actuator and adjustment assembly may be permanently removed from the truss structure. This advantageously allows the erection of a truss structure using few actuators and adjustment assemblies, and reduces the number of components in the final erected structure.

It is a further object of the present invention to provide an adjustable truss structure which has means for facilitating a partially erected structure. It is an aspect of the invention that the truss structure can be quickly and easily erected merely by use of the tension cables discussed above. A truss structure including the tension cables can be quickly erected without the use of adjustment assemblies, by applying tension in the tension cables. By changing the amount of tension in the cables, as well as the relative amount of tension among the various cables, the truss structure can be "drawn up" into a self-supporting erect structure. This feature of the invention permits generalized control of the overall shape of the truss by adjusting the tension in the cables; which is sufficient for some applications. Furthermore, a truss initially erected in this way can subsequently be "fine tuned" using the adjustment assemblies described above.

It is a further object of the present invention to provide an adjustable truss structure which can be easily erected on an uneven site without extensive site preparation. This is advantageous as it permits less expensive construction on uneven sites, and permits construction on sites that may otherwise not be feasible.

Due to the geometric characteristics created by the non-parallelism of the successive hinges in the truss structure of the present invention, it has the ability to conform in three dimensions to the topology of any building site. A truss structure of the current invention may be formed as a closed loop of truss elements. The hinges associated with the elements forming the foundation would be adjusted to allow the elements to conform to the prevailing ground surface, following all irregularities and contours. The elements not forming the foundation would be erected as described above. Thus, the present invention easily and inexpensively accommodates uneven building sites.

BRIEF DESCRIPTION OF THE DRAWINGS

The invention will be further described with reference to the accompanying drawings, wherein.

DETAILED DESCRIPTION OF THE PREFERRED EMBODIMENTS

The structure of the invention will be described in conjunction with the drawings.

Figure 1:
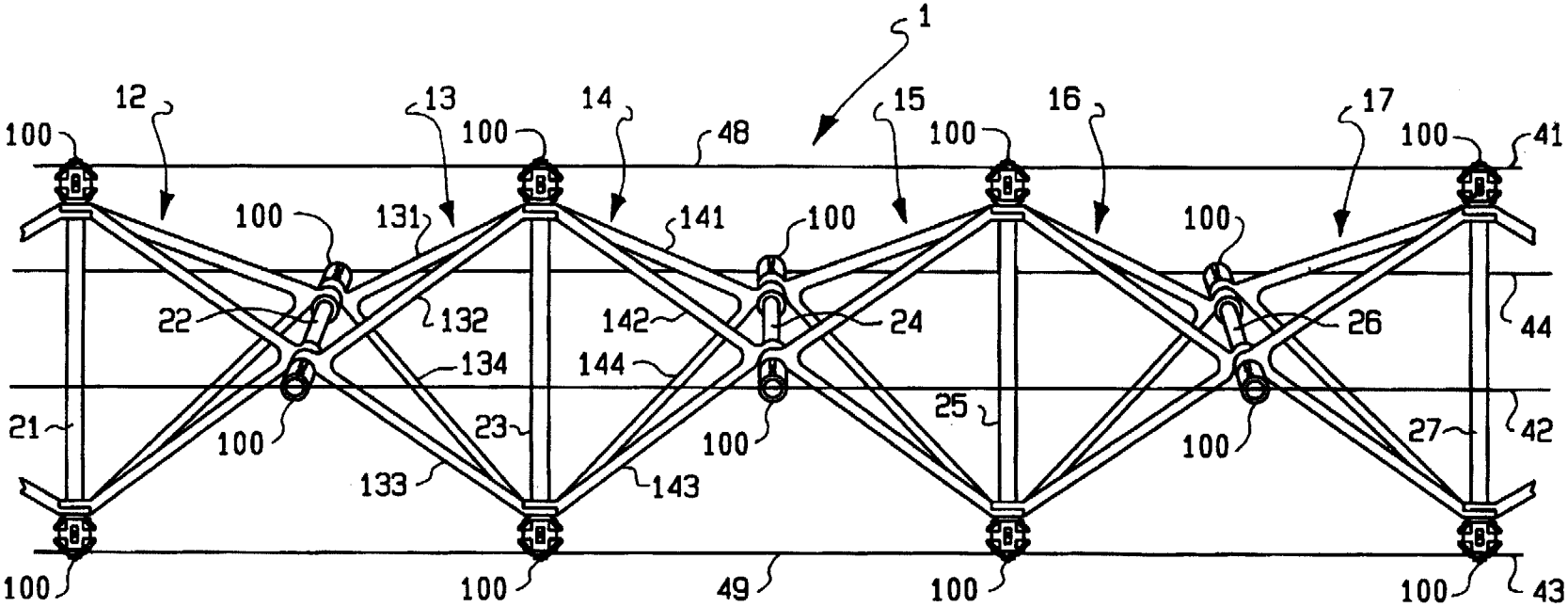
FIG. 1 is a perspective view of a portion of the truss according to the preferred embodiment of the invention, in its initial state.

FIG. 1 shows the truss 1 in an unadjusted state. The truss 1 is constructed by sequentially coupling truss elements, here equilateral tetrahedral elements 12, 13, 14, 15, 16, 17. Referring to tetrahedral element 14, it is coupled at its edges 23, 24 to the adjacent tetrahedral elements 13, 15 on either side. Thus, tetrahedral element 14 has a total of two shared edges 23, 24, and four independent edges 141, 142, 143, 144. The edges of the tetrahedral elements are also referred to herein as tetrahedral struts. Shared edges 23, 24 operate as hinges, allowing neighboring tetrahedral elements 13, 15 to pivot relative to tetrahedral element 14. The shared edges are also referred to herein as hinges.

If greater compressive strength was desired, the tetrahedral elements could be constructed to be solid-faced bodies, by forming them out of flat plates joined at the edges 92. In this embodiment, the pivoting could be achieved by separate hinges affixed to the solid-faced tetrahedral elements.

It is a significant aspect of the present invention that each individual tetrahedral element 12, 13, 14, 15, 16, 17 is of fixed shape. Unlike the adjustable truss structures in the prior art, three-dimensional shape adjustment of the overall truss is achieved not by distorting the shape of the tetrahedral elements, but merely by adjusting the pivotal angle between successive tetrahedral elements.

It can be observed that when the truss is in the unadjusted state illustrated in FIG. 1, the set of alternating hinges 21, 23, 25, 27 are all vertically oriented. These vertical hinges form a first set of parallel hinges. The set of alternating hinges 22, 24, 26 are all horizontally oriented, forming a second set of parallel hinges. Successive hinges (for example 22 and 23) in the structure are not parallel.

In the illustrated preferred embodiment, successive hinges are offset by ninety degrees from each other, and there are two sets of parallel hinges. It is preferred that successive hinges be consistently offset by an angle of X degrees, where X=360/2N, N being a whole number corresponding to the number of sets of parallel hinges. The illustrated embodiment represents the situation when N is 2 and therefore X is 90 degrees. This preferred embodiment advantageously simplifies analysis of the shape adjustment of the overall truss, and further, maximizes the amount of adjustment that can be achieved for a given amount of force applied.

Other values of N may be used. For example, if N is 3, then X is 60 degrees. In this embodiment, every third hinge in the structure will be in a parallel set. There will be three sets of initially parallel hinges, and the hinges in each set will be offset by 60 degrees from hinges in the other sets.

Still referring to the preferred embodiment illustrated in FIG. 1, adjustment of angles of hinges in the first set (21, 23, 25, 27) permits adjustment of the shape of the truss in the horizontal plane. Adjustment of angles of hinges in the second set (22, 24, 26) permits adjustment in the vertical plane, such that adjustment of these hinges permits erection of the truss 1 up from the surface. A combination of adjustments in the two different planes permits the truss structure to be adjusted in three dimensions. This three-dimensional adjustability permits the truss of the present invention to form useful shapes which could not be achieved by the "two-dimensionally adjustable" trusses known in the art.

It should be noted that an important aspect of the present invention which permits three-dimensional adjustability is the fact that not all hinges in the structure are parallel. The orderly pattern of hinges described above is preferred, but is not necessary to achieve three-dimensional adjustability. Even a truss constructed, for example, with a group of successive hinges along its length being entirely parallel would be adjustable in three dimensions, so long as there were some hinges in the truss that were not parallel with the group of parallel hinges.

In the preferred embodiment of the truss, all truss elements are connected by hinges, thereby maximizing the flexibility in adjusting the shape of the truss. In other embodiments, however, it may be desired to rigidly connect some truss elements if there is no need for relative movement between them.

Tension cables 41, 42, 43, 44 are slidably received by cable guide and clamping means located on the hinge nodes 100 at the ends of each hinge. When the truss is in the unadjusted state illustrated in FIG. 1, the tension cables describe straight lines parallel to the longitudinal axis of the truss.

Tensile forces may be provided through the tension cables in order to change the shape of the truss. For example, the application of a tensile force in tension cable 43 will tend to effect a change in the angles of hinges 22, 24, 26, such that the truss will tend toward an arched, or inverted "U" shape. When the tensile force in tension cable 43 is of sufficient magnitude, it will lift the central portion of the truss up from the surface. Conversely, a tensile force in tension cable 41 will tend to shape the truss towards an upright "U" shape. Forces in either one of the tension cables 41 and 43 affect the shape of the truss in the vertical plane.

The application of a tensile force in tension cables 42 and 44 will tend to effect a change in the angles of hinges 23 and 25, such that the truss will tend towards and arcuate shape, where the change in the shape of the truss is in the horizontal plane only. A combination of tensile forces in cables 41 or 43, in the first instance, and cables 42 or 44 in the second instance, will affect changes in the shape of the truss in both the vertical and horizontal planes. In this way, the shape of the truss may be fully adjusted in three dimensions, using the cables as the sole means for providing the adjustment force.

The truss of the present invention may be fabricated somewhere other than the building site, and transported in a compact folded form. The truss may first be fully fabricated as illustrated in FIG. 1, then alternating hinges may be temporarily disconnected from a hinge node at one end. The entire truss can then be folded, accordion style, into a very compact volume. For example, temporarily disconnecting one end of hinges 22, 24 and 26 would permit the folding of the structure by compressing the truss along its longitudinal axis. As the truss is compressed lengthwise, the tetrahedra are flattened and the truss expands cross-sectionally. The extent of the compression of the truss is limited only by the thickness of hinges and associated hinge nodes 100. The illustrated truss could be compressed until hinges 21 through 27 are in successive contact and the resulting length of the compressed truss would be the sum of the diameters of these seven hinges. Once the truss is transported to the building site, it is a simple matter to unfold the truss, restoring the tetrahedral elements to the illustrated shape, and to reconnect the ends of the hinges.

Figure 2:
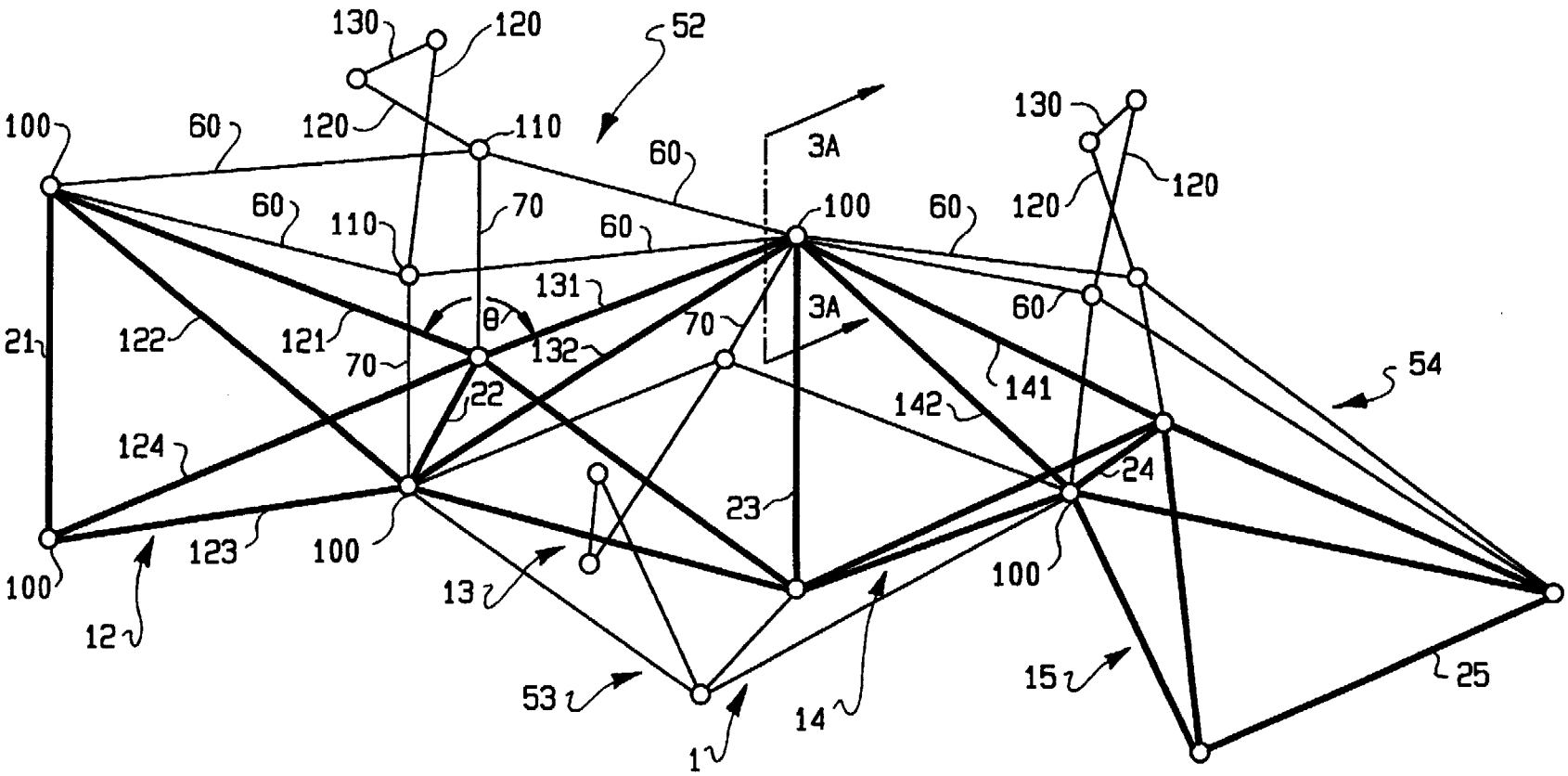
FIG. 2 is a perspective line drawing of a portion of the truss according to the preferred embodiment of the invention, illustrating additional structures not shown in FIG. 1, and further illustrating the truss adjusted from the initial state.

As discussed above, the force for adjustment of the shape of the truss may be provided solely through the tension cables. In an alternate preferred embodiment, the force for the adjustment of the hinge angles is applied in whole or in part by adjustment assemblies associated with specific individual hinges. FIG. 2 shows a portion of the truss illustrated in FIG. 1, after adjustment of the hinge angles from the initial state. FIG. 2 further includes adjustment assemblies 52, 53, 54 not shown in FIG. 1. The tension cables have been omitted from this diagram for clarity, as have portions of additional adjustment assemblies associated with hinges 21 and 25 which would appear if this were a segment of an actual truss.

The hinge angle θ of hinge 22 is defined by the angle, about the axis formed by hinge 22, between the first imaginary plane defined by struts 22, 121, 122 of tetrahedral element 12, and the second imaginary plane defined by struts 22, 131, 132 of tetrahedral element 13. Adjustment assembly 52 is used to adjust the hinge angle θ of hinge 22. Adjustment assemblies 53 and 54 will similarly effect changes in the hinge angles of hinges 23 and 24, respectively.

Adjustment assembly 52 includes four adjustment rods 60, which are linked so as to form a quadrilateral linkage connecting the hinge nodes 100 associated with hinges 21 and 23. The linkage is reinforced by two support struts 70, which prevent the quadrilateral linkage from collapsing towards or away from the hinge 22. Adjustment rods 60 are each pivotally connected to a hinge node 100 at one end, and to an adjustment node 110 at the other end.

The truss shown in FIG. 2 illustrates only one adjustment assembly associated with each hinge. In a preferred embodiment of the present invention, the truss would include a symmetric pair of adjustment assemblies associated with each hinge. For example, an adjustment assembly complementary to adjustment assembly 53 would be essentially a mirror image of adjustment assembly 53, on the other side of hinge 23. A change in the hinge angle of hinge 23 could then be controlled by simultaneously employing the complementary pair of adjustment assemblies. By providing a pair of adjustment assemblies for each hinge, the force required from each individual actuator means 130 could be reduced.

In addition to providing a path to transmit forces from the actuators, the adjustment assemblies also serve as mechanical limits for the hinge angles during erection. For example, adjustment assembly 54 serves to limit the angle of hinge 24. In FIG. 2, adjustment assembly 54 is shown in an almost fully extended state. Additional clockwise adjustment of the angle of hinge 24 will cause adjustment assembly 54 to become fully extended. Subsequent adjustment of the angle of hinge 24 will be prevented by adjustment assembly 54. In general, the adjustment of a hinge angle will be limited by the length of the adjustment rods comprising the associated adjustment assemblies. The dimensions of the adjustment rods are selected so as to allow the amount of hinge adjustment corresponding to the desired amount of folding of the structure, and no more.

Actuator means 130 mounted between levers 120 are further associated with each adjustment assembly. Forces applied by the actuator means 130 are transmitted through the levers 120 to the associated adjustment assembly. It can be seen that as the actuator 130 is extended, the corresponding adjustment nodes 110 will be forced apart. This will in turn pull the corresponding hinge nodes 100 together, decreasing the hinge angle θ of hinge 22. Conversely, if the actuator means 130 is contracted, the hinge angle θ will increase. The control of the actuator means position may be manual or microprocessor-controlled, depending on the accuracy required.

Possible actuator means include a mechanical rack and pinion, pneumatic cylinders, hydraulic cylinders, or linear ball screws. The selection of these or other actuator means will depend on the specific application in which the truss is to be used.

As discussed above, the overall force for the erection and adjustment of the truss shape may be provided through the tension cables 41, 42, 43, 44. The actuators 130, may provide a supplemental force to specific hinges, so as to control the precise angle of the hinges. As the force is applied through the tension cables, a supplemental force is applied through the adjustment assemblies at the same time, so as to control the amount of the force from the tension cables which is applied to the individual hinges. In this way, individual hinge angles can be precisely controlled.

This erection and shaping method can be understood by referring to FIG. 1. It can be seen that the application of a sufficient tension force in tension cable 43, for example, will tend to draw the truss up into an inverted "U" shaped arch, affecting the hinge angles of hinges 22, 24, and 26. The force provided through the tension cable 43 does not allow for precise control of the individual hinge angles for the hinges 22, 24, and 26. However, if the truss were equipped with adjustment assemblies associated with these hinges, forces could be applied by these adjustment assemblies, simultaneously with the application of a force in tension cable 43, to control the amount of the force from the cable communicated to each hinge. This would allow precise, individual, control of the angles of hinges 22, 24, and 26.

It is readily apparent to one skilled in the art that the use of tension cables to provide the erection and shaping force can be achieved using the tension cables 41, 42, and 44, as well as cable 43 as described above. When using the other tension cables, the use of adjustment assemblies associated with hinges other than those described above may be required to control the truss shape. For example, if tension is applied in cables 42 or 44, adjustment assemblies associated with hinges 21, 23, 25, and 27 would be used to control the hinge angles of the associated hinges.

The truss erection and shaping method described above allows for the application of the primary erection and shaping force through the tension cables, while using the actuators and adjustment assemblies for control and guidance purposes. This is advantageous as it reduces the size and cost requirements for the actuators and adjustment assemblies, which are not required to provide the entire force required for truss erection and shaping.

In an alternate preferred embodiment, the force for the adjustment of the hinge angles may be applied in whole or in part by the actuator means. If the actuators are used to provide all of the force required for the shape adjustment of the truss, the only function of the cables is to bear the structural tensile loads in the erected structure.

The use of the cables to maintain desired hinge angles can be understood by referring again to FIG. 1. Assuming that all tension cables 41, 42, 43, 44 are clamped at hinge nodes 100, the truss structure would be "locked" in the illustrated configuration. For example, it can be seen that the hinge nodes 100 of hinges 23 and 25 define two tension cable segments 48 and 49, which segments are of fixed length when the cables are clamped. Any force tending to change the hinge angle of hinge 24 would be opposed by tension in one or the other of these tension cable segments 48, 49. Thus it is seen that once the hinge angles are adjusted as desired, the tension cables may be used to "lock" the selected hinge positions.

It is significant that the tension cables serve as major structural components, in addition to their role in the shape adjustment of the truss as discussed above. In comparison to the traditional truss made exclusively of rigid struts, the present invention advantageously uses the tension cables to bear tensile loads in the erected structure. Cables resist tensile loads uniformly in cross-section, as contrasted with rigid struts, in which secondary bending moments lead to non-uniform stress distribution across the cross-section of the strut, especially at the ends of the strut (nodal points). As a result, in order to bear a given tensile load, a rigid strut of greater cross-sectional area is required, as compared to a cable. Furthermore, cables may be coiled, making them easier to transport to the construction site, and making the construction process more rapid and economic.

As the cables serve to lock selected hinge angle positions, the adjustment assemblies are thus not required to maintain the shape of the erected structure, they may be removed after erection is complete and all hinge positions are locked. This feature of the present invention advantageously reduces the number of components required in the final erected structure.

Referring again to FIG. 2, it is a significant aspect of the present invention that the tetrahedral elements and the cables (not shown) bear all the structural loads in the truss, and the actuator means 130 are not located in the load-bearing portion of the truss structure. This placement permits the selection of actuator means of sufficient strength to perform the truss shape adjustment, but does not require that the actuator means further possess sufficient strength to carry structural loads of the completed structure. Also, by placing the actuator means on the levers 120, the principles of mechanical advantage are employed, thus requiring less powerful actuators than would otherwise be required.

Figure 3A:
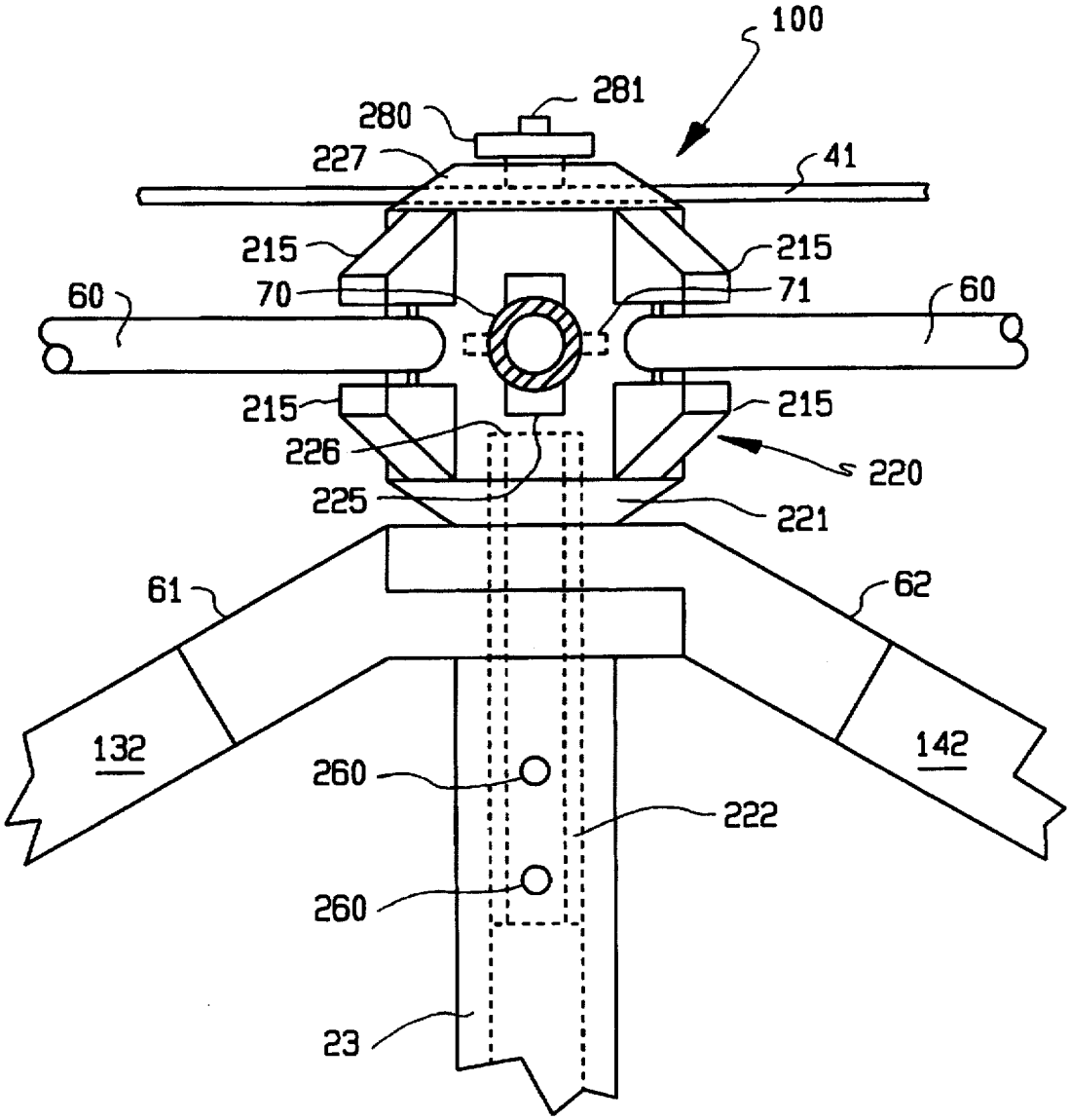
FIG. 3A shows a hinge node structure of the truss of FIG. 2 in the direction of the arrow 3A—3A.

FIG. 3A provides a detailed view of a hinge node 100, from the perspective of the line 3A—3A in FIG. 2. It should be noted that two adjustment rods 60 and struts 131, 141 visible in FIG. 2 are obscured behind the elements shown in FIG. 3A. Hinge node cap 220 has an upper portion 221, and a shank portion 222, of smaller diameter than the upper portion 221.

In a preferred embodiment, the shank portion 222 is separately formed from the upper portion 221, and is received in a cavity 226 provided in the bottom surface of the upper portion. The shank portion 222 may be affixed to the upper portion 221 by welding, mechanical fasteners, or other suitable methods. In an alternative embodiment, the hinge node cap 220 may be formed as a unitary part. The hinge 23 receives the shank portion 222 of the hinge node cap. The connection between the hinge node cap 220 and the hinge 23 is secured by bolts 260.

Cable 41 is received by cable guiding means at the end of the hinge node cap. In the illustrated embodiment, the cable guiding means is a groove 227 in the end of the hinge node cap. The groove 227 may be provided with means to facilitate smooth sliding of the cable through the groove, such as roller bearings. The cable is clamped by tightening the cable clamp bolts 281, which force cable clamp 280 against the cable, providing a frictional clamping of the cable 41.

Referring momentarily to FIG. 2, it can be seen that as the hinge angle of hinge 23 changes, the shape of adjustment assembly 53 will be affected, requiring pivotal movement of the associated support strut 70 at its point of connection to hinge node 100. In FIG. 3A, the spacing strut 70 is shown in cross-section. In order to permit the pivotal movement of the spacing strut 70, a bore 225 is provided in the upper portion 221 of the hinge node cap, as shown in FIG. 3A. Support strut 70 is received in the bore 225, and is pivotally attached to the hinge node cap by means of a pin 71.

Figure 3B:
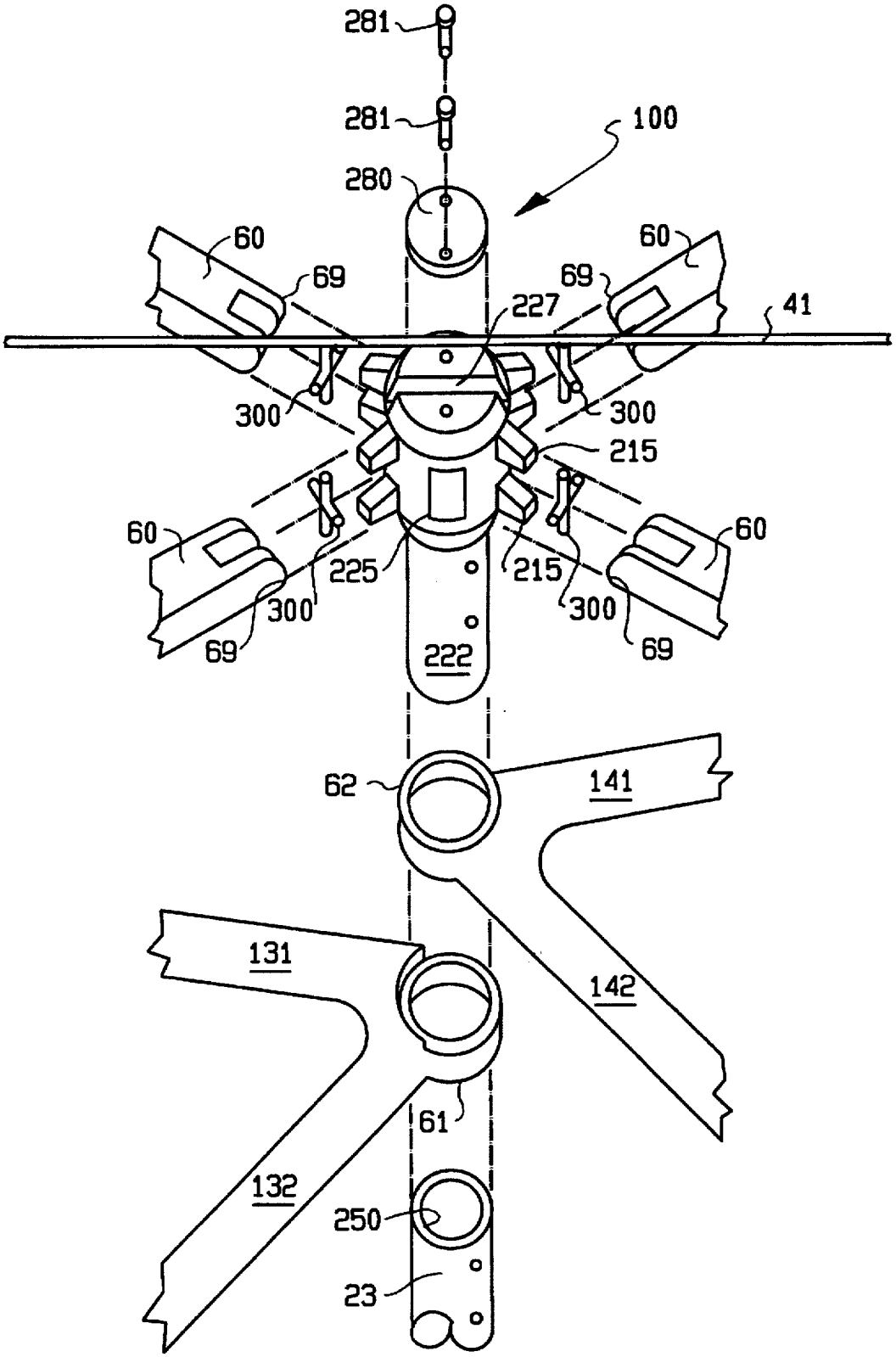
FIG. 3B shows the hinge node structure of FIG. 3A in an exploded view.

FIG. 3B provides an exploded view of the same hinge node illustrated in FIG. 3A. This view shows all of the adjustment rods and struts, including those which are obscured in FIG. 3A. Journal sections 61 and 62 are associated with tetrahedral elements 13 and 14, respectively. The journal sections 61, 62 are slidably received over the hinge 23, such that they can pivot about the axis defined by hinge 23. This pivoting movement allows the relative pivotal movement of tetrahedral elements 13 and 14, permitting adjustment of the hinge angle of hinge 23.

In the illustrated embodiment, the journal sections 61, 62 hold the corresponding struts in rigid relation to each other. For example, journal section 61 holds the struts 131, 132 in fixed relation; the struts rotate as a singe unit about hinge 23. This feature serves to strengthen the fixed shape of the tetrahedral elements.

In an alternative embodiment, each strut could terminate in an independent journal section, thus allowing for relative rotational movement of the struts within a single tetrahedral element. For example, referring momentarily to FIG. 1, struts 131, 132 could each have their own journal sections, allowing them to rotate independently about hinge 23. Such relative motion of struts within a single tetrahedral element would be necessary to permit deformation of the shape of the tetrahedral elements, for example to permit compact "accordion-style" folding of the truss structure for transportation. For example, temporarily disconnecting one end of hinges 22, 24 and 26 would permit the folding of the structure by compressing the truss along its longitudinal axis. As the truss is compressed lengthwise, the tetrahedra are flattened and the truss expands cross-sectionally. The extent of the compression of the truss is limited only by the thickness of hinges and associated hinge nodes 100. The illustrated truss could be compressed until hinges 21 through 27 are in successive contact and the resulting length of the compressed truss would be the sum of the diameters of these seven hinges.

Such independent motion of struts within a tetrahedral element could not occur in the erected structure, however. In the unfolded configuration illustrated in FIG. 1, the ends of struts 131, 132 distal to the ends attached to hinge 23 are pivotally attached to opposing ends of hinge 22. Hinge 22 and struts 131, 132 form a triangle. It is a well-known characteristic of triangles that the interior angles of a triangle cannot be changed unless the length of the sides are deformed. Therefore, in the unfolded configuration, the fixed length of hinge 22 serves to hold the struts 131, 132 in fixed angular relationship, such that they are constrained to rotate as a unit about hinge 23.

Referring again to FIG. 3B, adjustment rods 60 terminate in forked ends 69. The upper portion 221 of the hinge node cap is equipped with hinge node cap flanges 215 extending radially outward. The forked ends 69 are pivotally linked to the hinge node cap flanges 215 by a universal hinge 300, forming a universal joint. The two adjustment rods 60 on the right side of the hinge node 100 are associated with adjustment assembly 54, which controls the hinge angle of hinge 24. Similarly, the adjustment rods 60 on the left side of the hinge node 100 are associated with adjustment assembly 52, which controls the hinge angle of hinge 22.

Figure 4:
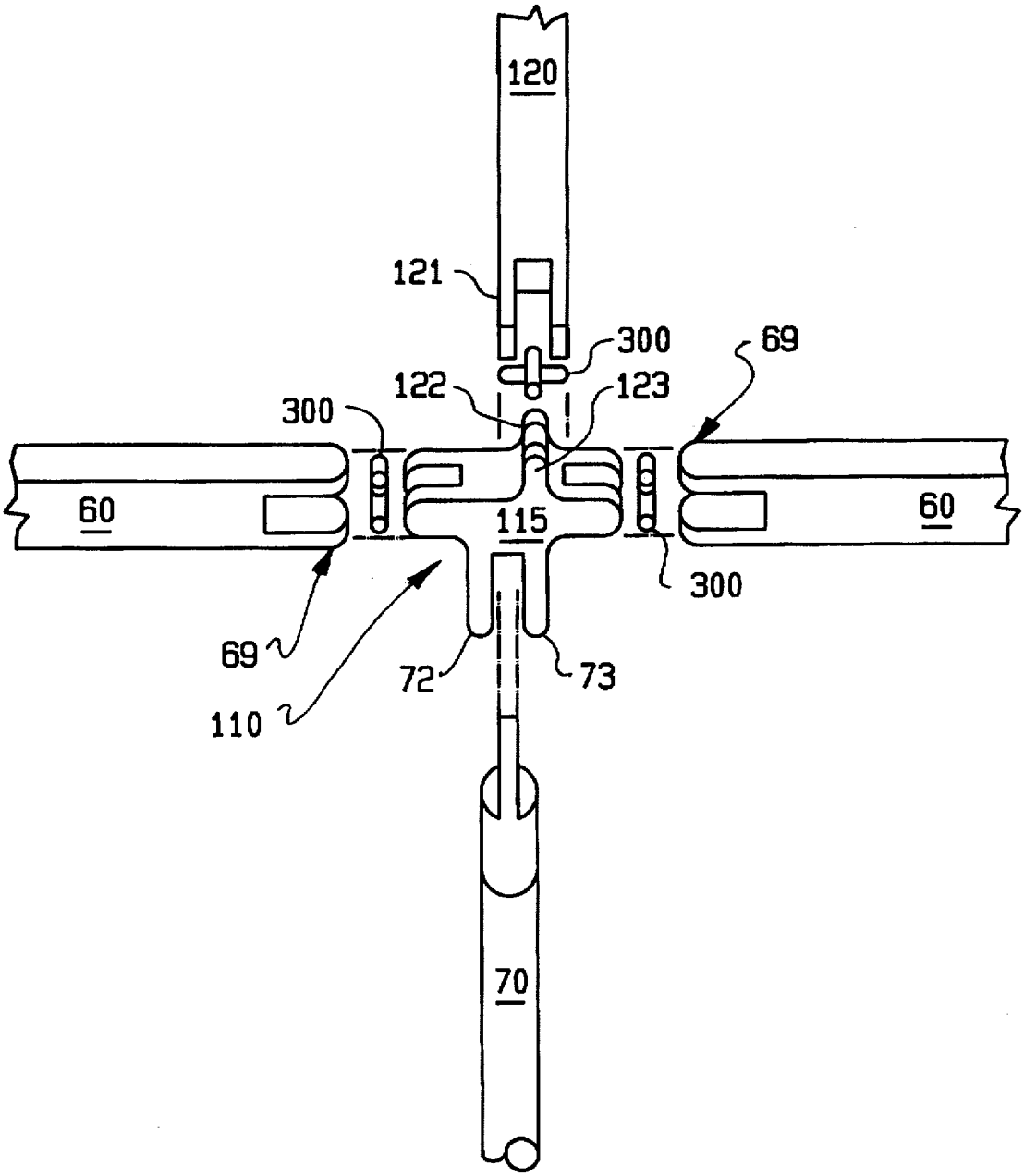
FIG. 4 shows an adjustment node structure of the truss of FIG. 2 in an exploded view.

FIG. 4 illustrates an exploded view of an adjustment node 110. Pivot element 115 serves as the connecting element for adjustment arms 60, support strut 70, and lever 120. The adjustment arms 60 and lever 120 are pivotally attached to the pivot element 115 by means of universal hinges 300, forming universal joint attachments.

Referring momentarily to FIG. 2, it can be seen that changes in the hinge angle θ of hinge 22 will correspond to changes in the shape of the diamond-shaped linkage formed by adjustment arms 60 of adjustment assembly 52. In response, the support struts 70 will pivot in the plane containing hinge 22 and associated hinge nodes 110. As the support struts 70 are therefore only required to pivot in a plane, they are connected to pivot element 115 by a simple pivot joint. The pivot joint is formed by pivotally mounting the flat strut blade 71 between the pivot element flanges 72, 73.

Pivot element 115 is formed with adjustment arm flanges 122, 123. The forked end 121 of adjustment arm 120 is pivotally connected to the adjustment arm flanges 122, 123 by means of a universal hinge 300. The location of the adjustment arm flanges 122, 123 is offset from the center of pivot element 115. The reason for this can be understood by referring again to FIG. 2. The two lever arms 120 corresponding to adjustment assembly 52 form a scissors-pair. In order for the two lever arms to smoothly pivot against each other, each lever arm must be offset in opposite directions by one half the width of the arm. The lever arm 120 shown in FIG. 4 is offset to the right, therefore the corresponding lever arm would be offset to the left, such that the abutting faces of the arms at the pivot point will meet on a plane, permitting smooth sliding motion.

Figure 5A:
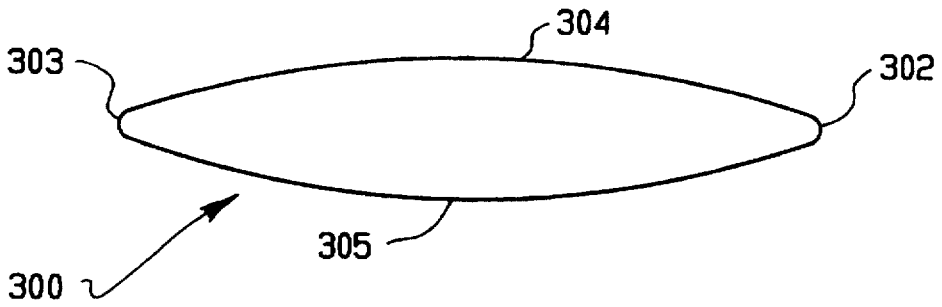
FIGS. 5A–5C are schematic drawings of a preferred embodiment of the truss of the present invention in a closed loop configuration in various stages of erection.
Figure 5B:
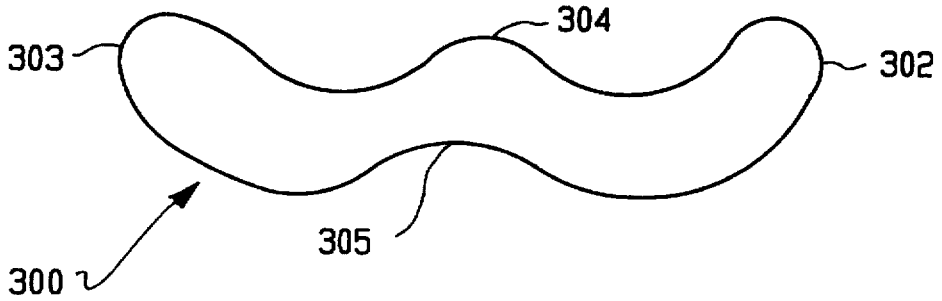
Figure 5C:
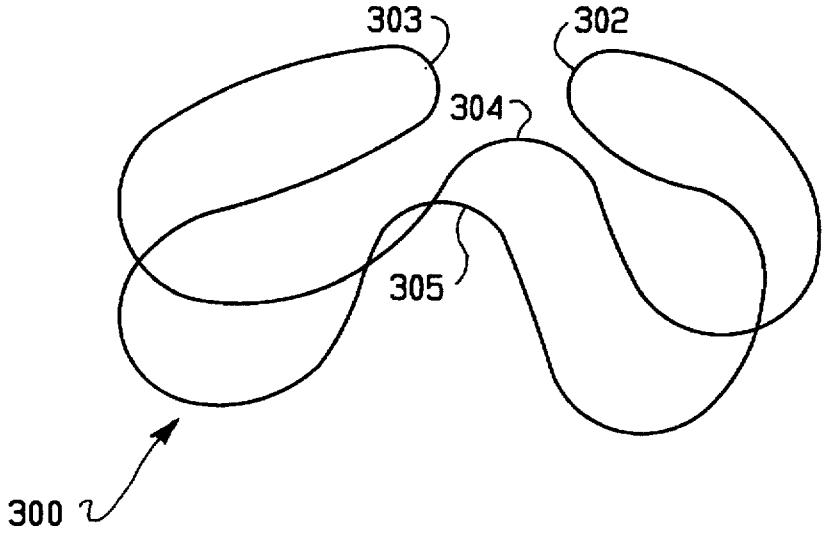
Figure 6:
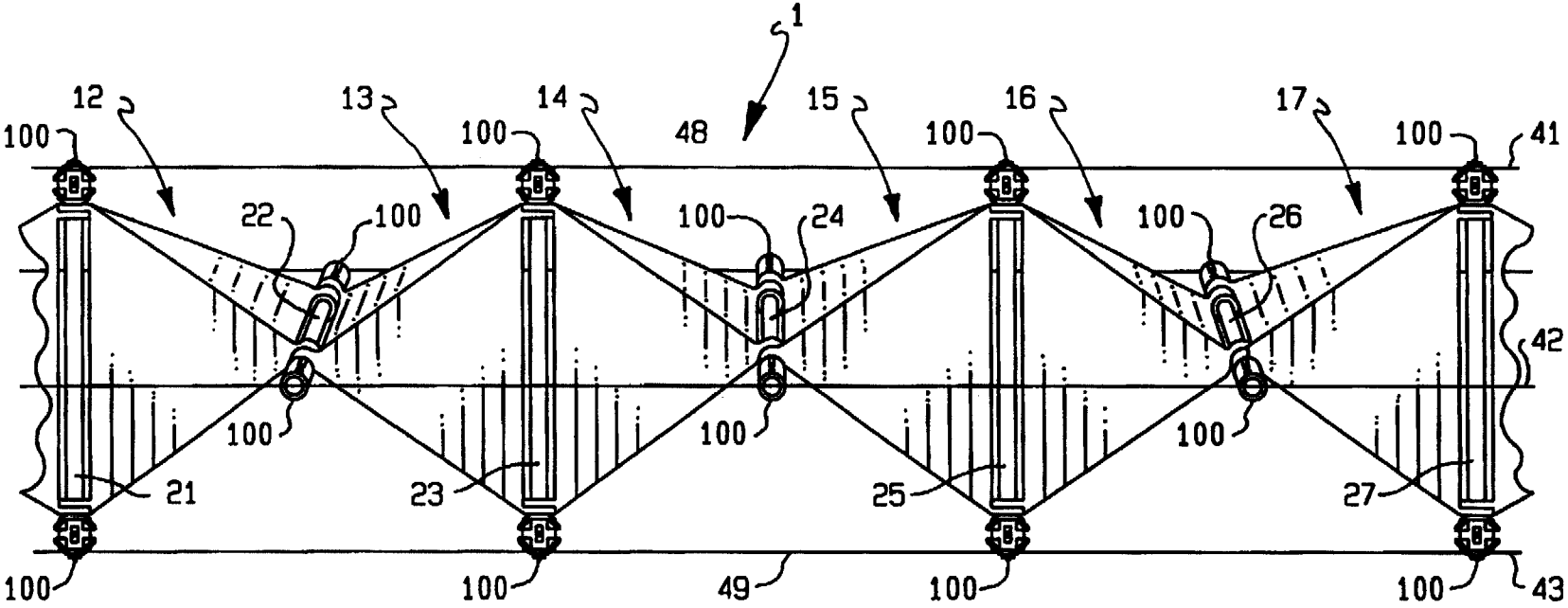
FIG. 6 is a perspective view of a portion of a truss according to the present invention, illustrating an embodiment in which the truss elements are constructed as solid-faced bodies.

With reference now to FIGS. 5A–5C, another preferred embodiment of the truss of this invention is shown as a truss of closed loop configuration. The truss illustrated in this series of figures would have a large number of individual truss elements, therefore for clarity they have not been individually depicted, but rather the truss is illustrated schematically as a simple line. FIG. 5A shows the closed loop truss 300 in the initial state, lying on a flat surface, forming an oval shape. FIG. 5B shows the closed loop truss in a partially erected state, after a plurality of hinge angles in the truss have been partially adjusted. The erected points 302, 303 have been lifted off the surface, as to a lesser degree have points 304, 305. FIG. 5C shows the truss in a fully erected state, after a plurality of hinge angles in the truss have been further adjusted beyond the positions reached in FIG. 5B. Erected points 302, 303 have lifted further off the surface, and towards each other. Erected points 304, 305 have also lifted somewhat further off the surface. The overall effect is that the perimeter of the closed loop truss 300 now forms a complex, three-dimensional curvilinear shape which encloses a volume of space above the surface to which the truss is fixed. Of course, an infinite number of three-dimensional shapes may be chosen, with the illustrated shape only being exemplary. The fully adjusted truss may be covered by a suitable material, such as a flexible structural mesh, sheathed in a suitable membrane, or by an architectural membrane alone, in order to fully enclose the volume of space.

The truss structure of the present invention can be used in two fundamentally distinct ways, depending on the condition of the building site.

First, if the building site is flat enough to permit it, the structure may be installed similar to a standard truss, in that the truss would be constructed as a beam of tetrahedral elements, the beam having two ends fixed to earth at the desired locations. The portion of the beam intermediate to the fixed ends would be erected by applying tension forces in the tension cables. The tension in the tension cables provides the force required to erect the structure. At the same time as the tension force is being applied to the cables, the adjustment assemblies associated with specific hinges can be adjusted, so as to control the amount of the force from the tension cables which is applied to each specific associated hinge. In this way, the position of each specific hinge can be precisely controlled. The tension cables provide the primary force to erect and shape the structure, while the adjustment assemblies provide the supplemental force to guide and control the shaping of the structure.

Shape adjustment of the overall structure may proceed by successively adjusting and locking the position of specific hinges. Alternatively, multiple hinges could be adjusted simultaneously, with each hinge being locked when it reached its desired hinge angle. Whichever method is used, the locking is accomplished by placing the cables under tension, and clamping cable segments corresponding to the hinges which have been adjusted. In this way, the tetrahedral elements are placed under compression, and tensile loads in the structure are borne by the tension cables.

Secondly, if the building site has an irregular surface, the truss could be constructed as a closed truss loop structure. One portion of the closed truss loop would be adjusted to conform to the prevailing ground surface, and subsequently could be fixed to the surface. This portion of the closed truss loop would thus serve the function of a traditional building foundation. The remaining portion of the closed truss loop would be erected as described above.

In either the open-ended beam or closed-loop configurations, the truss structure may be fully or partially erected without the use of actuators. By controlling the tension in and among the tension cables, the general configuration of the truss can be adjusted. Such erection may be all that is required in some applications. However, if precise adjustment of specific hinge angles is desired, this can be achieved by adjusting and locking the hinge angles as discussed above, and finally removing the adjustment assemblies from the structure. By varying the number of hinges which are precisely adjusted, any level of precision of shape adjustment of the overall truss may be achieved.

The advantageous features of the versatile geometry and dynamics of the truss of the present invention have no limitations of scale. Although the discussion above generally discusses the use of the truss in an architectural context, many other applications are readily apparent. Examples of other applications include, but are not limited to the following. Versions of the truss could be used in surgical, robotics, industrial design, space, and marine applications.

While specific embodiments of the invention have been described and shown in the drawings, further variations will be apparent to those skilled in the art, and the invention should not be construed as limited to the specific forms shown and described. The scope of the invention is to be determined solely by the claims.

What is claimed is:

1. An adjustable truss structure comprising:

(a) a plurality of truss elements; and (b) hinges pivotally connecting at least three successive truss elements, wherein not all hinges are parallel;

wherein at least one said hinge has a means for adjusting the angle between its associated truss elements.

2. The adjustable truss structure of claim 1, wherein said hinges are in N sets, every Nth hinge being in the same set, and all hinges in a set being substantially parallel when the longitudinal axis of the truss structure is a straight line.

3. The adjustable truss structure of claim 1, wherein successive hinges are substantially orthogonal.

4. The adjustable truss structure of claim 1 wherein the truss elements are tetrahedra.

5. The adjustable truss structure of claim 1 wherein the truss elements are comprised of struts joined at their ends, forming a framework.

6. The adjustable truss structure of claim 1 wherein the truss elements are comprised of solid plates joined at their edges, forming a solid-faced body.

7. The adjustable truss structure of claim 1, wherein the truss elements are arranged in a closed loop configuration.

8. The adjustable truss structure of claim 2, further comprising:

(a) clamping means affixed to the end of each hinge; and (b) a pair of structural members bearing tensile loads associated with each set of said hinges, wherein said clamping means releasably clamps said members at intermediate points along said members.

9. The adjustable truss structure of claim 2, wherein at least one hinge has an adjustment assembly for adjusting the angle between its associated truss elements, and further comprising actuating means associated with each adjustment assembly.

10. The adjustable truss structure of claim 9, wherein said adjustment assembly comprises a mechanical linkage.

11. The adjustable truss structure of claim 9 wherein the adjustment assembly is removable from the truss.

12. The adjustable truss structure of claim 2, wherein one end of every hinge in one set of hinges is releasably connected to its associated truss elements, such that the shape of the truss elements can be deformed, allowing the truss to be compressed.

13. An adjustable truss structure comprising:

(a) a plurality of tetrahedral truss elements;

(b) two sets of hinges pivotally connecting at least two pairs of adjacent truss elements;

(c) a pair of tension cables associated with each set of hinges;

(d) cable clamping means affixed to at least one end of each hinge, wherein said clamping means releasably clamps said cables at intermediate points along said cables;

(e) at least one hinge having an associated mechanical linkage for adjusting the angle between the truss elements associated with said hinge, said mechanical linkage being removable from the truss; and (f) actuating means associated with each mechanical linkage.

14. A method of constructing an adjustable truss structure, comprising the steps of:

(a) arranging a plurality of truss elements on a surface;

(b) pivotally connecting truss elements such that at least two pairs of adjacent truss elements are connected by hinges and not all hinges are parallel;

(c) connecting tension cables to the ends of a plurality of said hinges;

(d) selecting a hinge to be adjusted;

(e) applying a force to at least one of the associated truss elements on either side of said selected hinge, to adjust the hinge angle defined by the relative positions of said associated truss elements;

(f) clamping the tension cables to maintain the hinge angle selected in step (e); and (g) repeating the steps (d)–(f) for other hinges as necessary.

15. A method of constructing an adjustable truss structure, comprising the steps of:

(a) arranging a plurality of truss elements on a surface;

(b) pivotally connecting truss elements such that at least two pairs of adjacent truss elements are connected by hinges and not all hinges are parallel;

(c) connecting tension cables to the ends of a plurality of said hinges;

(d) applying tensile forces to selected tension cables such that truss elements lift off the surface into an erected form; and (e) clamping the tension cables to maintain the hinge angles achieved in step (d).

16. A method of constructing an adjustable truss structure, comprising the steps of:

(a) arranging a plurality of truss elements on a surface;

(b) pivotally connecting truss elements such that at least two pairs of adjacent truss elements are connected by hinges and not all hinges are parallel;

(c) connecting tension cables to the ends of a plurality of said hinges;

(d) applying tensile forces to selected tension cables such that truss elements lift off the surface into an erected form;

(e) selecting a hinge to be adjusted;

(f) applying a force to at least one of the associated truss elements on either side of said selected hinge, to adjust the hinge angle defined by the relative positions of said associated truss elements;

(g) clamping the tension cables to maintain the hinge angle selected in step (f); and (h) repeating the steps (e)–(g) for other hinges as necessary.

17. A method of constructing an adjustable truss structure, comprising the steps of:

(a) arranging a plurality of truss elements on a surface;

(b) pivotally connecting truss elements such that at least two pairs of adjacent truss elements are connected by hinges, wherein the relative position of said adjacent truss elements define the hinge angle of the hinges connecting them, and not all hinges are parallel;

(c) connecting tension cables to the ends of a plurality of said hinges;

(d) applying tensile forces to selected tension cables such that truss elements lift off the surface into an erected form, and while applying said tensile forces, controlling the amount of said tensile forces applied to at least one of said hinges, so as to control the adjustment of the hinge angle of said at least one of said hinges; and (e) clamping the tension cables to maintain the hinge angles achieved in step (d).

18. The method of constructing an adjustable truss structure of claim 17, wherein the amount of said tensile forces applied to at least one of said hinges is controlled by at least one mechanical linkage.

19. A method of constructing an adjustable truss structure, comprising the steps of:

(a) arranging a plurality of truss elements on a surface;

(b) pivotally connecting truss elements such that at least two pairs of adjacent truss elements are connected by hinges and not all hinges are parallel, and such that a closed loop of truss elements is formed;

(c) adjusting the hinge angles defined by the relative positions of truss elements in a first portion of the closed loop of truss elements, to permit said first portion to conform to the shape of the surface; and (d) adjusting the hinge angles defined by the relative positions of truss elements in a second portion of the closed loop of truss elements.

20. The method of constructing an adjustable truss structure of claim 19 further comprising the step of connecting tension cables to the ends of a plurality of said hinges, and wherein the step of adjusting said second portion of the closed loop of truss elements comprises:

(a) selecting a hinge to be adjusted;

(b) applying a force to at least one of the associated truss elements on either side of said selected hinge, to adjust the hinge angle defined by the relative positions of said associated truss elements;

(c) clamping the tension cables to maintain the hinge angle selected in step (b); and (d) repeating the steps (a)–(c) for other hinges as necessary.

21. The method of constructing an adjustable truss structure of claim 19 further comprising the step of connecting tension cables to the ends of a plurality of said hinges, and wherein the step of adjusting said second portion of the closed loop of truss elements comprises:

(a) applying tensile forces in the portion of the tension cables associated with said second portion of the closed loop, such that said second portion lifts off the surface into an erected form; and (b) clamping the tension cables to maintain the hinge angles achieved in step (a).

22. The method of constructing an adjustable truss structure of claim 19 further comprising the step of connecting tension cables to the ends of a plurality of said hinges, and wherein the step of adjusting said second portion of the closed loop of truss elements comprises:

(a) applying tensile forces in the portion of the tension cables associated with said second portion of the closed loop, such that said second portion lifts off the surface into an erected form;

(b) selecting a hinge to be adjusted;

(c) applying a force to at least one of the associated truss elements on either side of said selected hinge, to adjust the hinge angle defined by the relative positions of said associated truss elements;

(d) clamping the tension cables to maintain the hinge angle selected in step (c); and (e) repeating the steps (b)–(d) for other hinges as necessary.

23. The method of constructing an adjustable truss structure of claim 19 further comprising the step of connecting tension cables to the ends of a plurality of said hinges, and wherein the step of adjusting said second portion of the closed loop of truss elements comprises:

(a) applying tensile forces in the portion of the tension cables associated with said second portion of the closed loop, such that said second portion lifts off the surface into an erected form, and while applying said tensile forces, controlling the amount of said tensile forces applied to at least one of said hinges, so as to control the adjustment the hinge angle of said at least one of said hinges; and (e) clamping the tension cables to maintain the hinge angles achieved in step (d).

24. The method of constructing an adjustable truss structure of claim 23, wherein the amount of said tensile forces applied to at least one of said hinges is controlled by at least one mechanical linkage.

* * * * *